US010081053B2

(12) United States Patent
Vincent et al.

(10) Patent No.: US 10,081,053 B2
(45) Date of Patent: Sep. 25, 2018

(54) DISTRIBUTION DEVICE

(71) Applicant: Pyrotek Engineering Materials Limited, Milton Keynes (GB)

(72) Inventors: Mark Vincent, Milton Keynes (GB); Mark Palmer, Spokane Valley, WA (US)

(73) Assignee: PYROTEK ENGINEERING MATERIALS LIMITED, Milton Keynes (GB)

( * ) Notice: Subject to any disclaimer, the term of this patent is extended or adjusted under 35 U.S.C. 154(b) by 217 days.

(21) Appl. No.: 14/908,506

(22) PCT Filed: Aug. 11, 2014

(86) PCT No.: PCT/GB2014/052447

§ 371 (c)(1),
(2) Date: Jan. 28, 2016

(87) PCT Pub. No.: WO2015/022507

PCT Pub. Date: Feb. 19, 2015

(65) Prior Publication Data

US 2016/0167119 A1 Jun. 16, 2016

(30) Foreign Application Priority Data

Aug. 12, 2013 (GB) ..... 1314376.3
Apr. 17, 2014 (GB) ..... 1406937.1

(51) Int. Cl.
*B22D 11/103* (2006.01)
*B22D 11/041* (2006.01)
(Continued)

(52) U.S. Cl.
CPC ..... *B22D 11/103* (2013.01); *B22D 11/0401* (2013.01); *B22D 11/041* (2013.01); *B22D 11/049* (2013.01)

(58) Field of Classification Search
CPC . B22D 11/0401; B22D 11/041; B22D 11/049; B22D 11/103
(Continued)

(56) References Cited

U.S. PATENT DOCUMENTS 3,780,789 A * 12/1973 Unger ..... B22D 11/0401 164/420
4,986,337 A * 1/1991 Soulier ..... B22D 11/0401 164/420
(Continued)

FOREIGN PATENT DOCUMENTS

GB 773272 A 4/1957
GB 2492106 A 12/2012
JP 2001021271 A 1/2001

OTHER PUBLICATIONS

Marthinusen et al. "Insural insulating materials, Launder design and the use of tempcal modelling"; Proceedings of the International Workshop on Aluminium Meltprocessing Technologies, Oct. 1, 1998, pp. 1/7-7/7, XP002423254.

*Primary Examiner* — Scott R. Kastler
*Assistant Examiner* — Michael Aboagye
(74) *Attorney, Agent, or Firm* — Knobbe Martens Olson & Bear LLP

(57) ABSTRACT

A distribution device for use with a vertical casting system includes a body made of a refractory material, which includes a base and a peripheral wall. The base and the peripheral wall enclose a trough for containing and distributing liquid metal. A thermally insulating layer is located in a recess beneath the base. The refractory material of the body has a first thermal conductivity and the thermally insulating layer is made of a material having a second thermal conductivity that is less than the first thermal conductivity.

16 Claims, 4 Drawing Sheets

(51) Int. Cl.
*B22D 11/049* (2006.01)
*B22D 11/04* (2006.01)

(58) Field of Classification Search
USPC .... 266/242, 191, 196, 45, 46; 222/594, 590, 222/592, 146.1; 164/437, 439, 487, 488, 164/126
See application file for complete search history.

(56) References Cited

U.S. PATENT DOCUMENTS

| | | | | |
|---|---|---|---|---|
| 6,090,340 | A | 7/2000 | Boonacker et al. | |
| 6,550,528 | B1 * | 4/2003 | Ichiki ..... | B22D 11/006 164/421 |
| 6,848,497 | B2 * | 2/2005 | Sale ..... | B22D 11/103 164/437 |
| 7,059,383 | B1 | 6/2006 | Tremblay et al. | |
| 2004/0206473 | A1 | 10/2004 | Sale et al. | |
| 2005/0126738 | A1 | 6/2005 | Tingey et al. | |
| 2010/0109210 | A1 | 5/2010 | Vincent | |
| 2011/0140318 | A1 | 6/2011 | Reeves et al. | |

* cited by examiner

DISTRIBUTION DEVICE

RELATED APPLICATIONS

This application is the U.S. National Phase filing under 35 U.S.C. § 371 of PCT/GB2014/052447, filed Aug. 11, 2014, which designated the United States and was published in English as WO 2015/022507 on Feb. 19, 2015, which claims priority under 35 U.S.C. § 119(a)-(d) to Great Britain Patent Application No. 1314376.3, filed Aug. 12, 2013; and Great Britain Patent Application No. 1406937.1, filed Apr. 17, 2014, the entire contents of which are incorporated herein by reference.

FIELD OF THE INVENTION

The present invention relates to a distribution device for use with a vertical casting system and in particular, but not exclusively, for use with a direct chill casting system. The invention also relates to a casting table that includes a plurality of distribution devices, and to a direct chill casting system.

BACKGROUND OF THE INVENTION

Direct chill (DC) casting is an example of a vertical semi-continuous casting process, which is used for the fabrication of cylindrical billets from non-ferrous metals such as aluminium and alloys thereof. An example of a direct chill metal casting apparatus is described for example in U.S. Pat. No. 4,598,763. DC casting processes may also be used for the fabrication of metal ingots.

A DC casting apparatus typically includes a plurality of water-cooled moulds, each having an open ended vertical passageway through which the liquid metal flows. As the molten metal passes through the water-cooled moulds it is cooled causing the peripheral region of the metal to freeze. The mould is usually quite short (typically 75-150 mm) and as the metal emerges from the lower end of the mould it is cooled further by water jets causing the remainder of the metal to freeze, thereby forming a cylindrical billet. The lower end of the billet is supported by a starting head (or dummy block), which is lowered gradually (typically at a rate of 50-150 mm/min) by a hydraulic ram. Liquid metal is supplied continuously to the mould until the hydraulic ram reaches its bottom position. Typically, billets produced by the DC process have a diameter of 50-500 mm and a length of 4-8 meters.

A DC casting system normally has a plurality of moulds, typically allowing 2-140 billets to be formed simultaneously. The moulds are supported by a steel casting table and are fed with molten metal through a metal distribution system. There are two principal designs of DC casting system: in the first design the flow of metal is controlled by a float and in the second design the metal flows into mould through a feeding device made of a refractory material. The present invention relates to the second design, which is often called a "hot-top" casting system.

In a typical hot-top casting system the metal distribution system includes a plurality of refractory distribution devices called "cross feeders" that contain the liquid metal and distribute it to the moulds as the billets are formed. The distribution devices are typically made of a ceramic refractory material such as Insural® 140 made by Pyrotek Inc., which has a low thermal conductivity in order to prevent rapid cooling of the liquid metal before it passes through the moulds. The ceramic material must also have good mechanical properties. However, it can be difficult to obtain an ideal balance of mechanical and thermal properties, as refractory materials that have a very low thermal conductivity are often mechanically weak, whereas mechanically strong refractory materials tend to have a much higher thermal conductivity. Therefore, a refractory material with sufficient mechanical strength may have a relatively high thermal conductivity.

This can cause a number of problems. First, over an extended period of time (typically months or years) heat transferred by conduction from the liquid metal through the refractory distribution device to the steel casting table can cause distortion of the table through thermal fatigue. Typically, this results in a phenomenon known as "crowning", in which the table takes on a slightly domed shape with the centre of the table being higher than its edges. Second, loss of heat from the liquid metal as it flows around the distribution system can give rise to temperature differences in different parts of the distribution system, the metal typically being hottest near to the metal feed point and coolest in parts of the distribution system that are furthest from the feed point. This can cause problems with the casting process as the metal emerging from "hot" parts of the distribution system will freeze more slowly than metal from "cool" parts of the system, thus making it difficult to match the speed of the hydraulic ram to the freezing rate of the metal.

It is an object of the invention to provide a distribution device than mitigates one or more of the above problems.

SUMMARY OF THE INVENTION

According to one aspect of the present invention there is provided a distribution device for distributing liquid metal in a vertical casting system, the distribution device comprising a body made of a refractory material, the body including a base and a peripheral wall that together provide a trough for containing and distributing liquid metal, and a thermally insulating layer located beneath the base, wherein the refractory material of the body has a first thermal conductivity and the thermally insulating layer is made of an insulating material having a second thermal conductivity that is less than the first thermal conductivity.

The thermally insulating layer helps to reduce the conduction of heat from the liquid metal through the distribution device into the support table. This helps to reduce thermal fatigue in the support table. The reduced thermal conductivity of the distribution device also helps to reduce the rate at which heat is lost from the liquid metal, thereby reducing temperature gradients within the liquid metal and improving the quality and consistency of the metal billets formed by the casting system.

The use of a thermally insulating layer also optionally allows a wider range of materials to be selected for the body of the distribution device, including for example materials that have a higher thermal conductivity but a higher strength or other improved mechanical characteristics. The thermally insulating layer ensures that the rate of heat loss from the distribution device remains low, even though the body is made from a material having a higher thermal conductivity. The use of a material with improved mechanical properties allows the distribution device to be lighter and/or stronger, or to have an extended service life.

Advantageously, the second thermal conductivity is less than 50%, preferably less than 20%, and more preferably less than 10% of the first thermal conductivity.

Advantageously, the second thermal conductivity is less than 0.25 W/mK, preferably less than 0.1 W/mK, and more preferably less than 0.05 W/mK.

Advantageously, the body of the distribution device is made of a refractory ceramic material. The distribution device preferably comprises a cross feeder or any other refractory piece associated with the casting table that connects the cross feeders, for example an entry trough, crucifix trough or elbow.

Advantageously, the first thermal conductivity is in the range 0.25-1.0 W/mK, preferably 0.25-0.5 W/mK.

Advantageously, the thermally insulating layer is made of an insulating material selected from a range comprising microporous board material, a vacuum formed or pressed fibreboard, a refractory paper or a castable refractory material.

Advantageously, the body of the distribution device includes at least one flow channel in the peripheral wall through which liquid metal can flow to or from the distribution device, and at least one feed hole in the base through which liquid metal can flow from the distribution device during a casting operation.

Advantageously, the body of the distribution device includes an inlet flow channel A in a first part of the peripheral wall through which liquid metal can flow into the distribution device, an outlet flow channel B in a second part of the peripheral wall through which liquid metal can flow from the distribution device, and a main flow trough C that extends from the inlet flow channel to the outlet flow channel and through which liquid metal can flow through the distribution device from the inlet flow channel to the outlet flow channel, wherein the trough further includes at least one branch trough D that extends in a substantially perpendicular direction from the main flow trough, said branch trough including at least one feed hole in the base thereof.

Advantageously, the body of the distribution device is configured so that a plurality of distribution devices can be arranged in an array such that the outlet channel of one distribution device is aligned with and sealingly connected to the inlet channel of an adjacent distribution device.

Advantageously, the thermally insulating layer comprises a pre-formed pad.

Advantageously, the thermally insulating layer has a thickness in the range 3-25 mm, preferably 5-15 mm, more preferably 8-12 mm.

In one preferred embodiment, the body includes a recess in the base of the body, and the thermally insulating layer is located within the recess. Advantageously, the recess has a depth equal to or greater than the thickness of the thermally insulating layer.

Advantageously, the body includes a peripheral rim that extends around the periphery of the recess in the base of the body. Advantageously, the peripheral rim has a width in the range 5-25 mm, preferably 8-15 mm.

In another preferred embodiment, the base of the body is substantially flat and the thermally insulating layer is located beneath the base the body.

Advantageously, the thermally insulating layer covers at least 50%, preferably at least 70% of the area of the base.

Advantageously, the distribution device includes at least one feed hole that extends through the base of the body and the thermally insulating layer.

According to another aspect of the invention there is provided a casting table assembly for a vertical casting system, the casting table including a support table and a plurality of distribution devices mounted on the support table, at least one of said plurality of distribution devices comprising a distribution device according to any one of the preceding statements of invention that includes a body and a thermally insulating layer, wherein the layer is positioned between the base of the body and the support table.

Advantageously, the support table includes one or more guide components for guiding liquid metal from the distribution device to one or more casting sites, including one or more components selected from a range that includes a thimble, a transition plate and a tubular casting ring.

Another aspect of the invention relates to a direct chill billet casting system that includes a casting table assembly according to any one of the preceding statements of invention, and a ram assembly that supports one or more metal billets cast by the system.

Advantageously, the support table includes one or more guide components for guiding liquid metal from the distribution device to one or more casting sites, including one or more components selected from a range that includes a thimble, a transition plate and a tubular casting ring.

According to a preferred embodiment of the invention there is provided a distribution device for distributing liquid metal in a vertical casting system, the distribution device comprising a body made of a refractory ceramic material, the body including a base and a peripheral wall that together provide a trough for containing and distributing liquid metal, at least one flow channel in the peripheral wall through which liquid metal can flow to or from the distribution device, and at least one feed hole in the base through which liquid metal can flow from the distribution device during a casting operation, and a thermally insulating layer located beneath the base, wherein the refractory ceramic material of the body has a first thermal conductivity in the range 0.25-1.0 W/mK and the thermally insulating layer is made of an insulating material selected from a range comprising a microporous board material, a vacuum formed or pressed fibreboard, a refractory paper or a castable refractory material, said insulating material having a second thermal conductivity that is less than 50% of the first thermal conductivity.

According to another preferred embodiment of the invention there is provided a distribution device for distributing liquid metal in a vertical casting system, the distribution device comprising a body made of a refractory material and a thermally insulating layer located beneath the body, wherein the body includes a base having an upper side and a lower side, a peripheral wall that extends upwards from the upper side of the base to provide a trough for containing and distributing liquid metal, at least one feed hole in the base through which liquid metal can flow from the distribution device during a casting operation, a recess in the lower side of the base and a peripheral rim that extends around the periphery of the recess, wherein the thermally insulating layer is located within the recess in the base of the body, and wherein the refractory material of the body has a first thermal conductivity and the thermally insulating layer is made of an insulating material having a second thermal conductivity that is less than the first thermal conductivity.

Each of the preferred embodiments set out above may be combined with other advantageous features as set out in the preceding statements of invention.

Certain embodiments of the invention will now be described by way of example with reference to the accompanying drawings, wherein:

DETAILED DESCRIPTION OF THE PREFERRED EMBODIMENT

Figure 1:
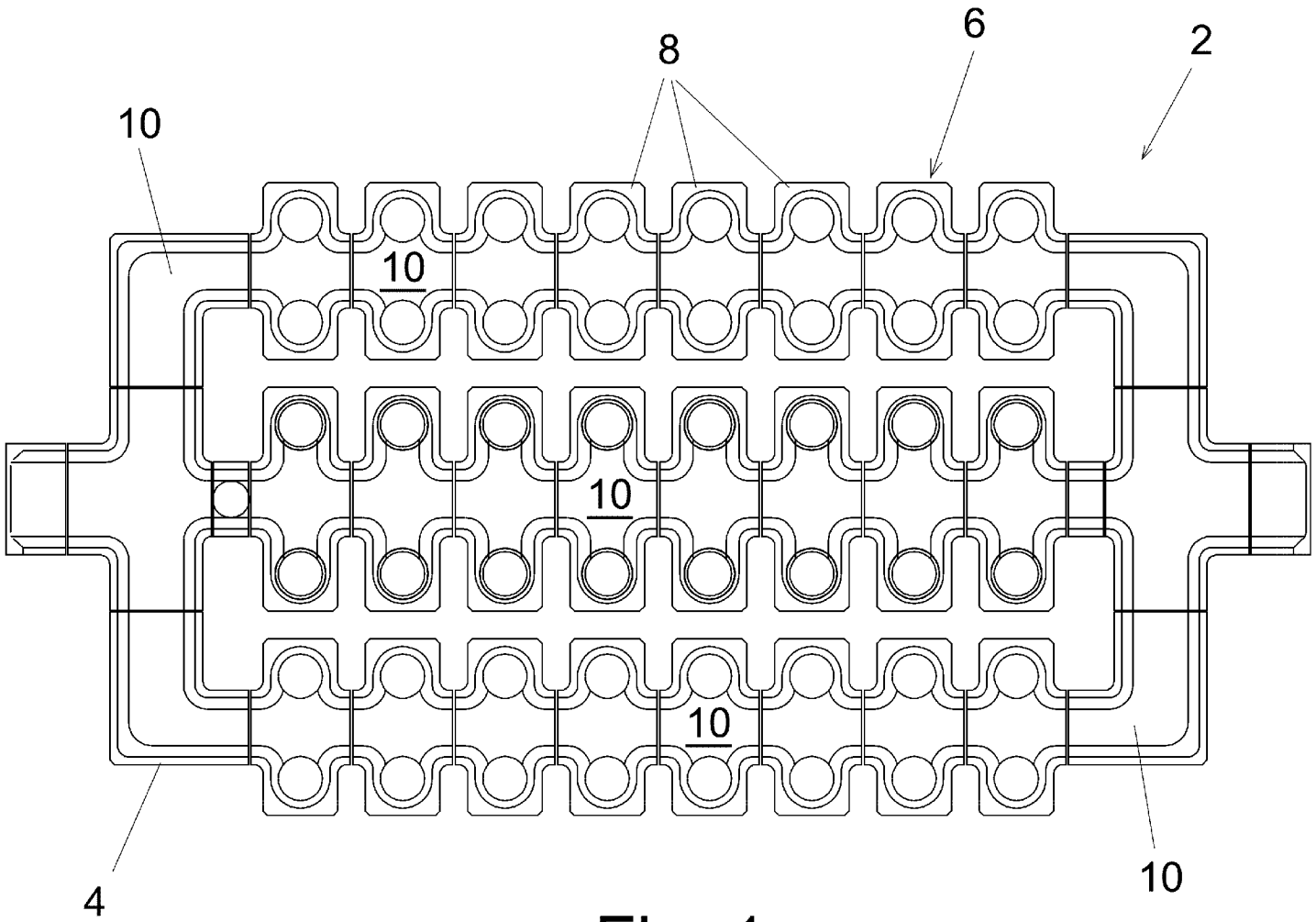
FIG. 1 is a plan view of a casting table for a DC casting system.
Figure 2:
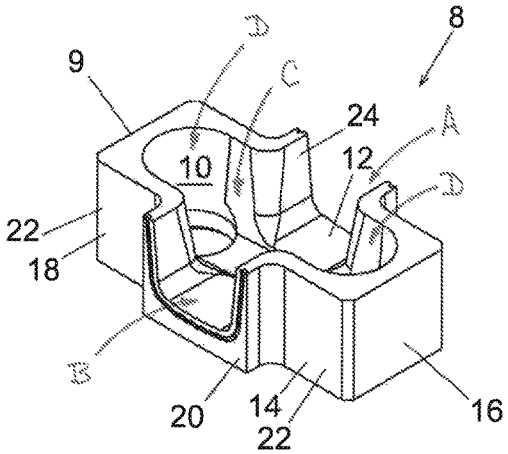
FIG. 2 is an isometric view of a distribution device according to a first embodiment of the invention.
Figure 5:
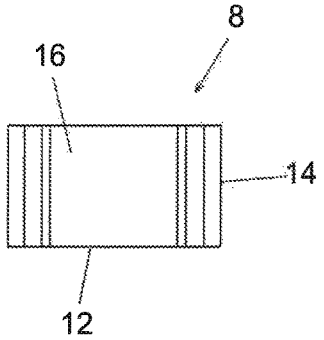
FIG. 5 is an end view of the distribution device.
Figure 3:
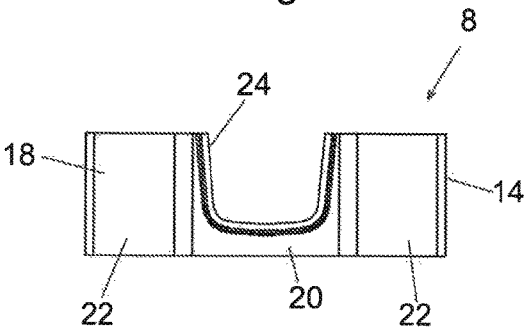
FIG. 3 is a side view of the distribution device.
Figure 6:
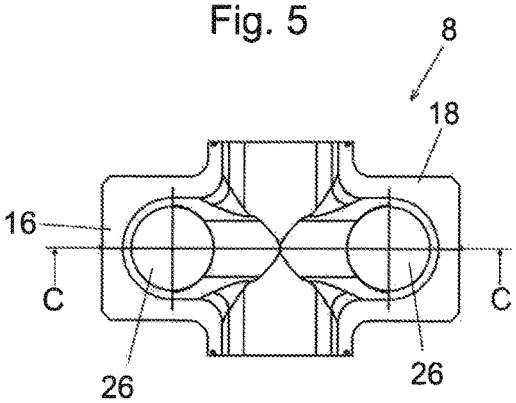
FIG. 6 is a plan view showing the upper side of the distribution device.
Figure 4:
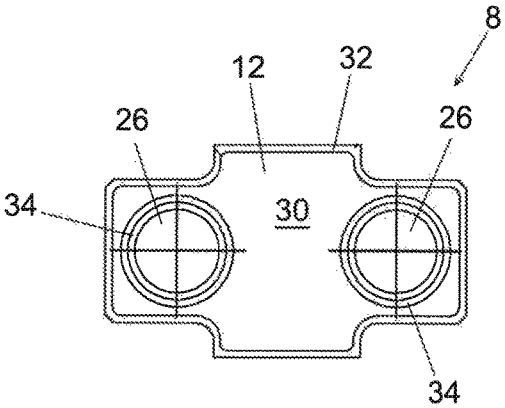
FIG. 4 is a plan view showing the lower side of the distribution device.
Figure 7:
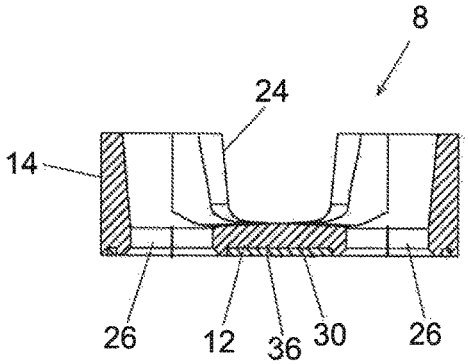
FIG. 7 is a side section on line CC of FIG. 6.

The casting table 2 shown in FIG. 1 comprises a rectangular steel support table 4 and a distributor system 6 comprising a plurality of refractory distribution devices 8, which together define an open-topped trough 10 for containing and distributing liquid metal to a plurality of casting sites beneath the table 4. This particular casting table 2 represents a preferred embodiment of the invention, which is suitable for use in a direct chill (DC) casting system for fabricating cylindrical billets from non-ferrous metals such as aluminium and alloys thereof. It should be understood however that the invention described herein is also applicable to other vertical casting systems, including DC casting systems for casting metal ingots.

A distribution device 8 according to an embodiment of the invention is shown in FIGS. 2-7. The distribution device 8 includes a refractory body 9, which is made of a refractory ceramic material and includes a base 12 and a peripheral wall 14 that extends upwards from the base 12. The base 12 and the peripheral wall 14 together define one section of the open-topped trough 10. The peripheral wall 14, which may be continuous or discontinuous, comprises two short end walls 16 and two longer side walls 18. Each side wall 18 includes a central section 20 and two ends sections 22. The innermost parts of the end sections 22 curve outwards and the central section 20 thus stands out beyond the plane of the end sections 22. A U-shaped channel 24 is formed in the central section 20, which extends downwards from the top edge of the peripheral wall 14 through approximately two thirds of the height of the distribution device.

When a plurality of distribution devices 8 are mounted together on a casting table as shown in FIG. 1 the central section 20 of each side wall 18 abuts the central section of the side wall of an adjacent distribution device and the U-shaped channels 24 formed in the adjacent walls are aligned with one another forming the open-topped trough 10 that allows liquid metal to flow between the distribution devices 8.

Two circular feed holes 26 are provided in the base 12 of the refractory body 9. In use, liquid metal can flow through these holes 26 to the casting sites defined by the table 2, so as to form billets. Although in this embodiment the distribution device 8 has two feed holes 26, it may alternatively have more or fewer than two feed holes.

The base 12 of the refractory body 9 includes in its lower surface a shallow recess 30 that extends over the whole area of the base 12, apart from a peripheral rim 32 that follows the shape of the peripheral wall 14 and two circular base portions 34 that extend around the circular feed holes 26. In this example the recess 30 has a depth of about 10 mm. More generally, the recess 30 has a depth 3-25 mm, preferably 5-15 mm and more preferably 8-12 mm. The peripheral rim 32 and the circular base portions 34 each have a width of about 10 mm, more generally 5-20 mm, preferably 8-15 mm.

The recess 30 accommodates a thermally insulating pad 36 that is made of a material with a very low thermal conductivity. In this embodiment the layer comprises a pad 36 of thermally insulating material that is shaped to fit within the recess 30 in the base 12 of the refractory body 9, with a small clearance (e.g. about 1.0 mm) between the edge of the pad and the inner surface of the peripheral region 32. The pad 36 has a thickness of about 10 mm. More generally, the thickness of the pad is approximately 3-25 mm, preferably 5-15 mm and more preferably 8-12 mm. The thickness of the thermally insulating pad 36 is preferably equal to or slightly less (e.g. 0.0-0.2 mm less) than the depth of the recess 30, so that the pad is not compressed between the refractory body 9 and the table 4. Optionally, the pad 36 may be attached to the underside of the refractory body 9 by means of a suitable adhesive.

The provision of the thermally insulating pad 36 within the recess 30 reduces greatly the conduction of heat from the liquid metal through the distribution device 8 into the steel support table 4. This helps to reduce thermal fatigue in the steel support table. The reduced thermal conductivity of the distribution device 8 also reduces the rate at which heat is lost from the liquid metal, thereby reducing temperature gradients within the liquid metal and improving the quality and consistency of the metal billets formed by the DC casting system.

The thermal pad 36 is preferably made of a thermal insulation material having a thermal conductivity that is significantly less than the thermal conductivity of the ceramic material forming the refractory body 9. In other words the refractory material of the body has a first thermal conductivity and the insulating material of the thermally insulating pad has a second thermal conductivity that is less than the first thermal conductivity. Preferably, the second thermal conductivity is less than 50%, more preferably less than 20%, and even more preferably less than 10% of the first thermal conductivity. As one example the thermally insulating pad 36 may be made from a microporous board material such as Promalight®-320 made by Promat UK Ltd, which has a thermal conductivity at 800 C of 0.036 W/mK. Typically, where the thermal conductivity of the ceramic material forming the refractory body 9 is about 0.5 W/mK, the thermal pad may be made of a material having a thermal conductivity of less than 0.05 W/mK (i.e. about 10% of the thermal conductivity of the refractory material that forms the body 9.

Any suitable thermal insulation material may be used for the thermally insulating layer 36, and this layer may consist of a pre-formed pad that is received within the recess 30 or the layer may be formed within the recess 30, for example by casting a suitable castable refractory material within the recess. Some examples of suitable materials for the thermally insulating layer 36 are discussed below.

The thermally insulating layer 36 preferably covers at least 50% (more preferably at least 70%) of the area of the base 12 of the refractory body 9, excluding the area of the feed holes 26. In this example, the layer comprises a pad that covers approximately 70% of the area of the base 12: i.e. the whole of the base apart from the area taken up by the peripheral rim 32 and the two circular base portions 34. In some circumstances a smaller pad may be sufficient. For example a pad covering only the central region of the base 12 between the feed holes 26 may suffice.

The reduced thermal conductivity provided by the thermally insulating pad 36 allows a ceramic material to be chosen for the refractory body 9 of the distribution device 8 that has a high mechanical strength as well as a relatively low thermal conductivity. For example, the body 9 of the distribution device may be made from Insural® 140 made by Pyrotek Inc., which has a cold crushing strength of 20 MPa, a modulus of rupture at room temperature of 4.5 MPa and a thermal conductivity at a temperature of 686 C of 0.47 W/mK. The material is also highly resistant to cracking with thermal cycling. Any other suitable material may also of course be used, including for example Pyroform HP made by Rex Roto Inc. Typically, the ceramic material will have a thermal conductivity in the range 0.25-0.5 W/mK, although materials with a higher thermal conductivity may also be used in certain circumstances, particularly if a thicker pad is used in a deeper recess.

Figure 8:
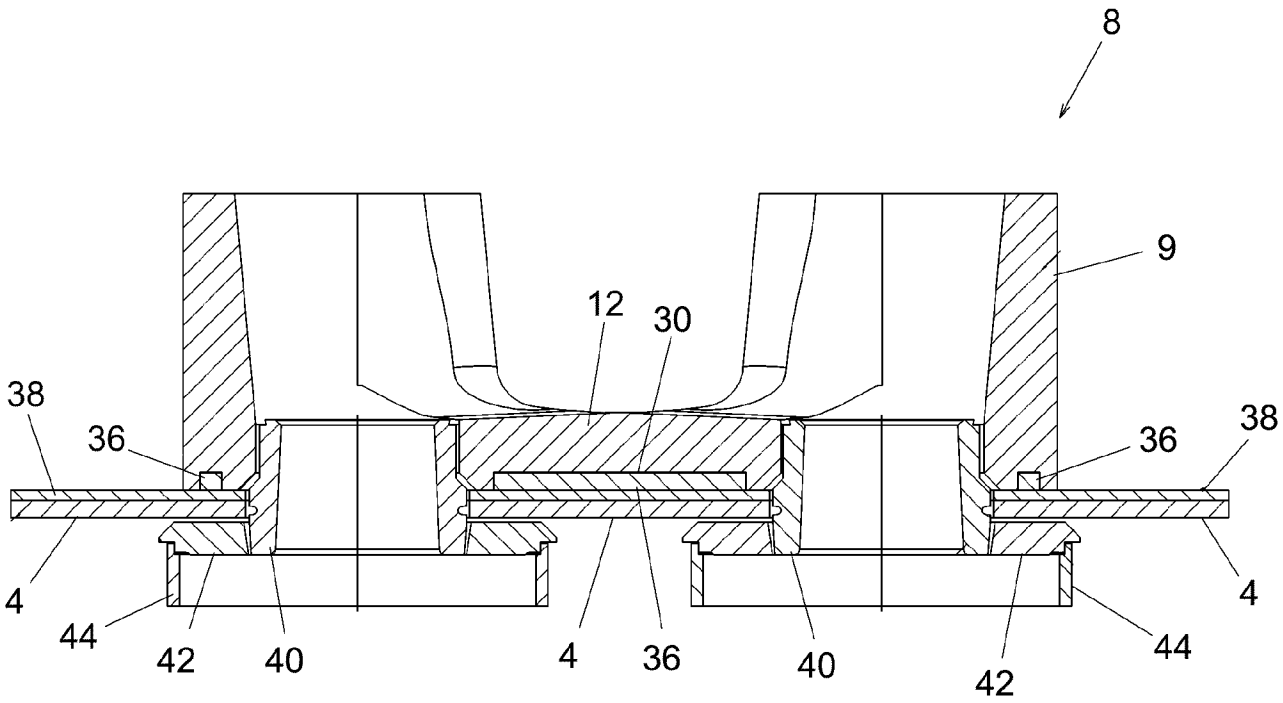
FIG. 8 is a sectional view of a casting table assembly including a distribution device.

In use, the distribution device 8 is mounted on the support table 4 as shown in FIG. 8, with the thermally insulating pad 36 located within the recess 30 in the base 12 of the refractory body 9. A sheet of ceramic paper 38 is positioned between the distribution device 8 and the upper surface of the support table 4. Additional refractory components of the casting system may be provided to guide the flow of liquid aluminium from the distribution device 8 through the table 4 during formation of a billet. These refractory components may include for example a cylindrical sleeve (or "thimble" or "scupper") 40 that fits within the circular feed hole 26 and extends through the base of the refractory body 9 and the thickness of the table 4, a circular transition plate (or "top ring") 42 that extends radially outwards from the lower end of the thimble 40 below the lower surface of the table 4, and a tubular cylindrical graphite casting ring (or "casting mould") 44 that extends downwards from the outer periphery of the transition plate 42. These components are all conventional and may for example be as described in U.S. Pat. No. 4,598,763.

The thermally insulating pad 36 located between the refractory body 9 of the distribution device 8 and the upper surface of the support table 4 reduces the rate at which heat is conducted from the liquid aluminium in the distribution device 8 to the support table 4, thereby helping to maintain the temperature of the liquid aluminium in the distribution device and avoiding excessive heating of the table 4. The quality of the cast aluminium can thus be improved and made more predictable, and damage to the table caused by excessive heating can be avoided.

Figure 9:
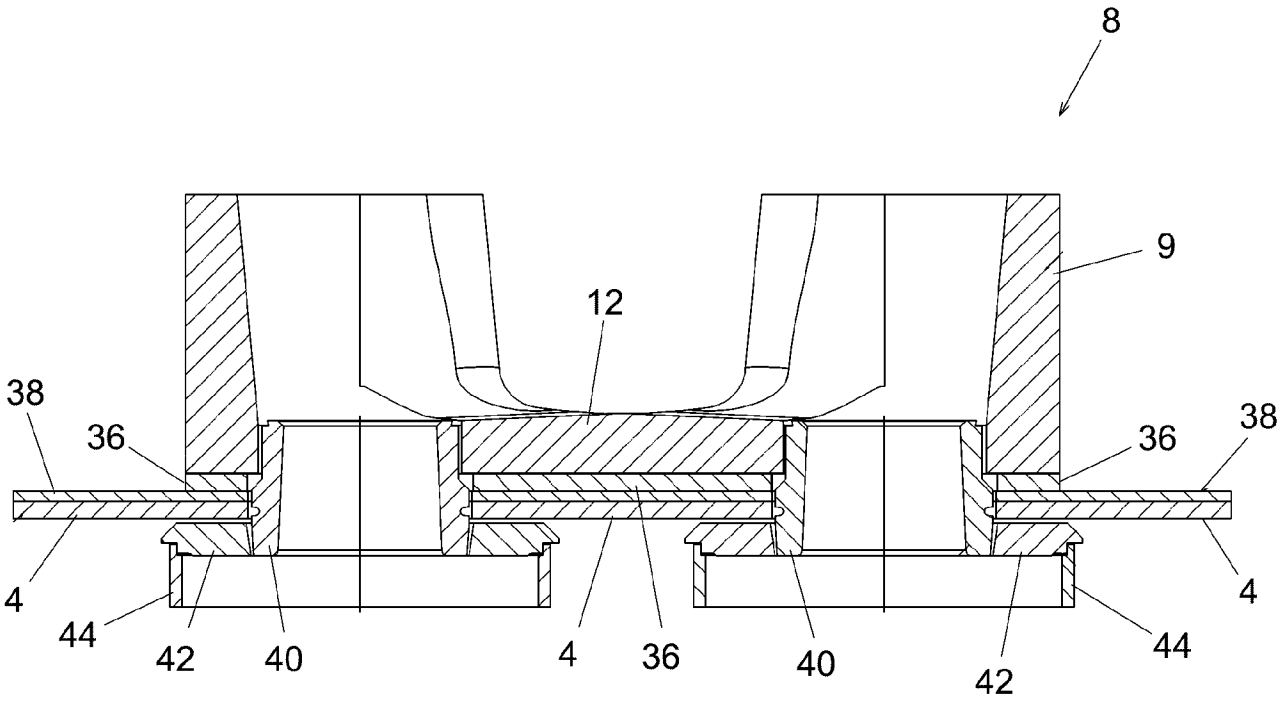
FIG. 9 is a sectional view of a casting table assembly including a distribution device according to a second embodiment of the invention.

A distribution device 8 according to a second embodiment of the invention is shown in FIG. 9. This distribution device is similar to the first embodiment shown in FIGS. 1-8 and described above, except that the peripheral rim 32 and the two circular base portions 34 of the first embodiment have been omitted and the thermally insulating pad 36 has been extended to cover the entire area of the base 12 of the refractory body 9. Therefore, in this embodiment the refractory body 9 does not have a recess and the lower side of the base 12 is flat. The base 12 of the refractory body 9 is however thinner than the base of a conventional distribution device, in order to accommodate the thickness of the pad 36 without increasing the overall height of the distribution device 8. For example, the thickness of the base 12 may be reduced by 3-25 mm, preferably 5-15 mm and more preferably 8-12 mm, as compared to a conventional distribution device.

Test Results

In order to prove the effectiveness of the invention a test was carried out to compare the thermal conductivity of a new distribution device according to the invention with that of a conventional distribution device. In each case the body of the distribution device was made from the same castable refractory material (in this case a proprietary material called Pyrotek X-75.1) and to the same design, except that the conventional distribution device had a base thickness of 50 mm whereas the new distribution device had a 10 mm deep recess formed in the base, leaving a base thickness of 40 mm. Alternatively, a commercially available refractory material such as Insural® 140 could have been used. A thermally insulating layer comprising a pad of Promalight®-320 micro-porous insulating material with a thickness of approximately 10 mm was placed in the recess.

The thermal conductivity of both distribution devices was measured at a range of temperatures using a test method according to ASTM C-8 Proposal 142. The results are set out below.

1. Conventional Distribution Device

Thermal conductivities calculation table
Identification: X-75.1 50 mm thick

Density: 92.9 lb/ft $^3$ Thickness: 1.97 in
Emissivity: 0.95 49.95 mm

| Hot face temperature ° C. | Cold face temperature ° C. | Ambient Temperature ° C. | Air Velocity $\frac{m}{s}$ | Mean Temperature ° C. | Thermal Conductivity $\frac{W}{m\,°K}$ |
|---|---|---|---|---|---|
| Rapid K apparatus | | | — | 25 | |
| | | | — | 100 | |
| 99 | 51 | 20 | 0.26 | 75 | 0.419 |
| 194 | 88 | 21 | 0.25 | 141 | 0.449 |
| 400 | 163 | 22 | 0.26 | 282 | 0.526 |
| 604 | 227 | 22 | 0.27 | 416 | 0.577 |
| 803 | 286 | 24 | 0.29 | 545 | 0.640 |
| 1000 | 337 | 26 | 0.32 | 668 | 0.690 |

2. New Distribution Device (Example 1)

Thermal conductivities calculation table
Identification: X-75.1 40 mm thick + micropore Density: 78.1 lb/ft$^3$ Thickness: 1.99 in
Emissivity: 0.95 50.43 mm

| Hot face temperature ° C. | Cold face temperature ° C. | Ambient Temperature ° C. | Air Velocity $\frac{m}{s}$ | Mean Temperature ° C. | Thermal Conductivity $\frac{W}{m\,°K}$ |
|---|---|---|---|---|---|
| Rapid K apparatus | | | — | 25 | |
| | | | — | 100 | |
| 99 | 31 | 20 | 0.24 | 65 | 0.100 |
| 193 | 45 | 21 | 0.26 | 119 | 0.103 |
| 400 | 71 | 20 | 0.24 | 235 | 0.106 |
| 605 | 97 | 21 | 0.24 | 351 | 0.111 |
| 804 | 124 | 21 | 0.22 | 464 | 0.120 |
| 1000 | 161 | 22 | 0.24 | 581 | 0.146 |

As can be seen from the results set out above, the thermal conductivity of the distribution device at a hot face temperature of about 800K is reduced from 0.640 W/mK for the conventional distribution device to 0.120 W/mK for the new distribution device. The thermal conductivity for the new distribution device is therefore less than 20% that of the conventional distribution device. Heat loss from the liquid aluminium in the new distribution device will therefore be considerably reduced.

Various modifications of the distribution device described above are of course possible. For example, any suitable thermal insulation material may be used for the thermal insulating layer 36, including for example a microporous insulating board such as Promalight®-320, a vacuum formed or pressed fibreboard such as Pyrotek® U1 millboard, or a refractory paper such as Insulfrax® paper. These materials may all be used to make a pre-formed pad that can then be located in the recess 30 or located beneath the distribution device. Alternatively, a castable refractory material such as Pyrotek® Wollite 30ST-1 may be used to form a moulded thermally insulating layer by casting the material directly into the recess 30.

The body of the distribution device may also be made from various refractory materials including for example Insural® 140 made by Pyrotek Inc. or Pyroform® HP made by Rex Roto Inc. Materials with a higher thermal conductivity may also be used in certain circumstances, particularly if a thicker insulating layer is provided beneath the distribution device.

The invention claimed is:

1. A distribution device for distributing liquid metal in a vertical casting system, the distribution device comprising a body made of a refractory ceramic material, the body including a base and a peripheral wall that together provide a trough for containing and distributing liquid metal, and a thermally insulating layer located beneath the base, wherein the body of the distribution device includes at least one flow channel in the peripheral wall through which liquid metal can flow to or from the distribution device, and at least one feed hole in the base through which liquid metal can flow from the distribution device during a casting operation, wherein the body includes a recess in the base of the body, and the thermally insulating layer is located within the recess, wherein the refractory ceramic material of the body has a first thermal conductivity and the thermally insulating layer has a thickness in a range of 3-25 mm and is made of an insulating material having a second thermal conductivity that is less than the first thermal conductivity and is less than 0.1 W/mK wherein the body of the distribution device includes an inlet flow channel in a first part of the peripheral wall through which liquid metal can flow into the distribution device, an outlet flow channel in a second part of the peripheral wall through which liquid metal can flow from the distribution device, and a main flow trough that extends from the inlet flow channel to the outlet flow channel and through which liquid metal can flow through the distribution device from the inlet flow channel to the outlet flow channel, wherein the trough further includes at least one branch trough that extends in a substantially perpendicular direction from the main flow trough, said branch trough including at least one feed hole in the base thereof.

2. The distribution device according to claim 1, wherein the second thermal conductivity is less than 50% of the first thermal conductivity.

3. The distribution device according to claim 1, wherein the second thermal conductivity is less than 0.05 W/mK.

4. The distribution device according to claim 1, wherein the first thermal conductivity is in a range of 0.25-1.0 W/mK.

5. The distribution device according to claim 1, wherein the thermally insulating layer is made of an insulating material selected from the group consisting of a microporous board material, a vacuum formed or pressed fiberboard, a refractory paper and a castable refractory material.

6. The distribution device according to claim 1, wherein the body of the distribution device is configured so that a plurality of distribution devices can be arranged in an array such that the outlet channel of one distribution device is aligned with and sealingly connected to the inlet channel of an adjacent distribution device.

7. The distribution device according to claim 1, wherein the thermally insulating layer comprises a pre-formed pad.

8. The distribution device according to claim 1, wherein the thermally insulating layer has a thickness in a range of 5-15 mm.

9. The distribution device according to claim 1, wherein the recess has a depth equal to or greater than the thickness of the thermally insulating layer.

10. The distribution device according to claim 1, wherein the body includes a peripheral rim that extends around the periphery of the recess in the base of the body.

11. The distribution device according to claim 10, wherein the peripheral rim has a width in a range of 5-25 mm.

12. The distribution device according to claim 1, wherein the base of the body is substantially flat and the thermally insulating layer is located beneath the base the body.

13. The distribution device according to claim 1, wherein the thermally insulating layer covers at least 50% of the area of the base.

14. The distribution device according to claim 1, wherein said at least one feed hole that extends through the base of the body also extends through the thermally insulating layer.

15. A distribution device for distributing liquid metal in a vertical casting system, the distribution device comprising a body made of a refractory ceramic material, the body including a base and a peripheral wall that together provide a trough for containing and distributing liquid metal, at least one flow channel in the peripheral wall through which liquid metal can flow to or from the distribution device, and at least one feed hole in the base through which liquid metal can flow from the distribution device during a casting operation, and a thermally insulating layer located beneath the base, wherein the body includes a recess in the base of the body, and the thermally insulating layer is located within the recess, wherein the refractory ceramic material of the body has a first thermal conductivity in the range 0.25-1.0 W/mK and the thermally insulating layer has a thickness in a range of 3-25 mm and is made of an insulating material selected from a range comprising a microporous board material, a vacuum formed or pressed fibreboard, a refractory paper or a castable refractory material, said insulating material having a second thermal conductivity that is less than 50% of the first thermal conductivity wherein the body of the distribution device includes an inlet flow channel in a first part of the peripheral wall through which liquid metal can flow into the distribution device, an outlet flow channel in a second part of the peripheral wall through which liquid metal can flow from the distribution device, and a main flow trough that extends from the inlet flow channel to the outlet flow channel and through which liquid metal can flow through the distribution device from the inlet flow channel to the outlet flow channel, wherein the trough further includes at least one branch trough that extends in a substantially perpendicular direction from the main flow trough, said branch trough including at least one feed hole in the base thereof.

16. A distribution device for distributing liquid metal in a vertical casting system, the distribution device comprising a body made of a refractory material and a thermally insulating layer located beneath the body, wherein the body includes a base having an upper side and a lower side, a peripheral wall that extends upwards from the upper side of the base to provide a trough for containing and distributing liquid metal, at least one feed hole in the base through which liquid metal can flow from the distribution device during a casting operation, a recess in the lower side of the base and a peripheral rim that extends around the periphery of the recess, wherein the thermally insulating layer is located within the recess in the base of the body, and wherein the refractory material of the body has a first thermal conductivity and the thermally insulating layer is made of an insulating material having a thickness in a range of 3-25 mm and a second thermal conductivity that is less than the first thermal conductivity and is less than 0.1 W/mK wherein the body of the distribution device includes an inlet flow channel in a first part of the peripheral wall through which liquid metal can flow into the distribution device, an outlet flow channel in a second part of the peripheral wall through which liquid metal can flow from the distribution device, and a main flow trough that extends from the inlet flow channel to the outlet flow channel and through which liquid metal can flow through the distribution device from the inlet flow channel to the outlet flow channel, wherein the trough further includes at least one branch trough that extends in a substantially perpendicular direction from the main flow trough, said branch trough including at least one feed hole in the base thereof.

* * * * *